US005454327A

United States Patent [19]

Goirand

[11] Patent Number: 5,454,327

[45] Date of Patent: Oct. 3, 1995

[54] LOADING SYSTEM FOR CHAIRLIFT

[75] Inventor: Bernard Goirand, Sassenage, France

[73] Assignee: Pomagalski S.A., France

[21] Appl. No.: 208,279

[22] Filed: Mar. 10, 1994

[30] Foreign Application Priority Data

Apr. 1, 1993 [FR] France ..... 93 04207

[51] Int. Cl.[6] ..... B61B 1/00

[52] U.S. Cl. ..... 104/28; 104/173.1

[58] Field of Search ..... 104/28, 173.2, 104/178, 179, 173.1; 198/494, 498

[56] References Cited

U.S. PATENT DOCUMENTS

| | | | |
|---|---|---|---|
| 1,964,637 | 6/1934 | Hurxthal | 198/494 |
| 2,087,813 | 7/1937 | Peterson | 198/494 |
| 2,157,301 | 5/1939 | Newman | 198/494 |
| 2,232,623 | 2/1941 | Newman | 198/494 |
| 3,055,229 | 9/1962 | Mecham | 198/494 |
| 3,297,147 | 1/1967 | Sackett | 198/494 |
| 3,548,753 | 12/1970 | Thurston . | |
| 4,223,609 | 9/1980 | Montagner . | |
| 5,109,976 | 5/1992 | Mohri et al. | 198/494 |

FOREIGN PATENT DOCUMENTS

| | | | |
|---|---|---|---|
| 392617 | 5/1991 | Austria . | |
| 0430091 | 6/1991 | European Pat. Off. . | |
| 1178570 | 12/1958 | France | 198/494 |
| 2392857 | 12/1978 | France . | |
| 2069443 | 8/1981 | United Kingdom | 198/494 |

*Primary Examiner*—Mark T. Le
*Attorney, Agent, or Firm*—Parkhust, Wendel & Rossi

[57] ABSTRACT

A fixed grip chairlift comprises a continuously moving conveyor for transporting the skiers to the loading point, where they are catched up by the chair which moves at a higher speed. The chair impact is thus reduced and the chairlift speed may be increased. The conveyor comprises an endless belt which passes around two drums, each drum being barrel like shaped to centralise the belt on the drums during running. The drum outer surface has holes to allow the snow transported by the belt towards the drum to escape.

1 Claim, 2 Drawing Sheets

LOADING SYSTEM FOR CHAIRLIFT

This application is related to the commonly assigned co-pending U.S. application entitled "Chairlift with conveyor loading".

BACKGROUND OF THE INVENTION

The invention relates to an installation for loading skiers on a chairlift having a continuously moving cable and chairs coupled to the cable by fixed grips.

Since the chair moves relatively rapidly at the cable speed along the loading area the skiers have some difficulties to sit down properly. In detachable grip chairlifts the chairs are stopped or move at slow speed at the loading point but such chairlifts are complicated and more expensive.

It has already been proposed to provide under the drive sheave a slight slope in the centerline of the cable, on which the skiers move towards the loading point, where they are taken over by the chair which arrives from behind them. The start of the skiers is controlled by light signals or barriers but the skiers speed changes with the snow conditions and the skiers capabilities.

In U.S. Pat. No. 3,548,753 is disclosed a passenger loading installation having a conveyor by means of which the passengers are accelerated to a velocity substantially the same as that of the cable. After embarkment of the passengers the conveyor is stopped and the next passengers may step on the conveyor to be moved towards the loading point. The conveyor comprises an endless belt or band passing around drums at opposite ends of the belt, one of said drums being driven by a motor. The conveyor belt is exposed to snow and ice which could prevent reliable working. Conventional belt guiding systems, such as rollers laterally disposed on both sides of the belt, may cause icing of the conveyor, more particularly during the night, and failure of the conveyor. Further the snow is allowed to pile up onto the lower strand of the belt and this snow is conveyed towards the drum and between the belt and the drum, causing the belt derailment.

The object of the present invention is to provide a loading system which is not affected by the snow or the ice and will enable the chairlift to be operated with greater safety.

SUMMARY OF THE INVENTION

The present invention achieves these and other objects and advantages by providing a loading conveyor continuously moving at a speed less than the cable speed, and comprising an endless belt which passes around two drums, at least one of these drums being barrel like shaped to centralise automatically the belt. The drums or at least the drum on the entrance of the conveyor, have an outer surface provided with holes or nests, wherein the snow traped between the belt and the drum, may be housed and/or evacuated.

The conveyor belt is automatically centralised and additional guiding systems are not needed. The outer shape of the drum is not modified by the snow or ice conveyed by the belt and covering the outer drum surface so that the belt remains centralised.

The drum is advantageously hollow and the holes are in communication with this central hollow drum part to evacuate the accumulated snow. The drum may be constituted by a cylindrical core whereon a barrel like cambered sleeve is secured. The outer surface of the drum or of the sleeve has longitudinal grooves, confined by radial walls or fins having a curved front face. The drum may be a squirrel cage constituted by spaced longitudinal rods and the invention may be carried out in other ways.

Other objects and advantages of the invention will appear from a description of a preferred form thereof.

DESCRIPTION OF THE PREFERRED EMBODIMENT

Figure 1:
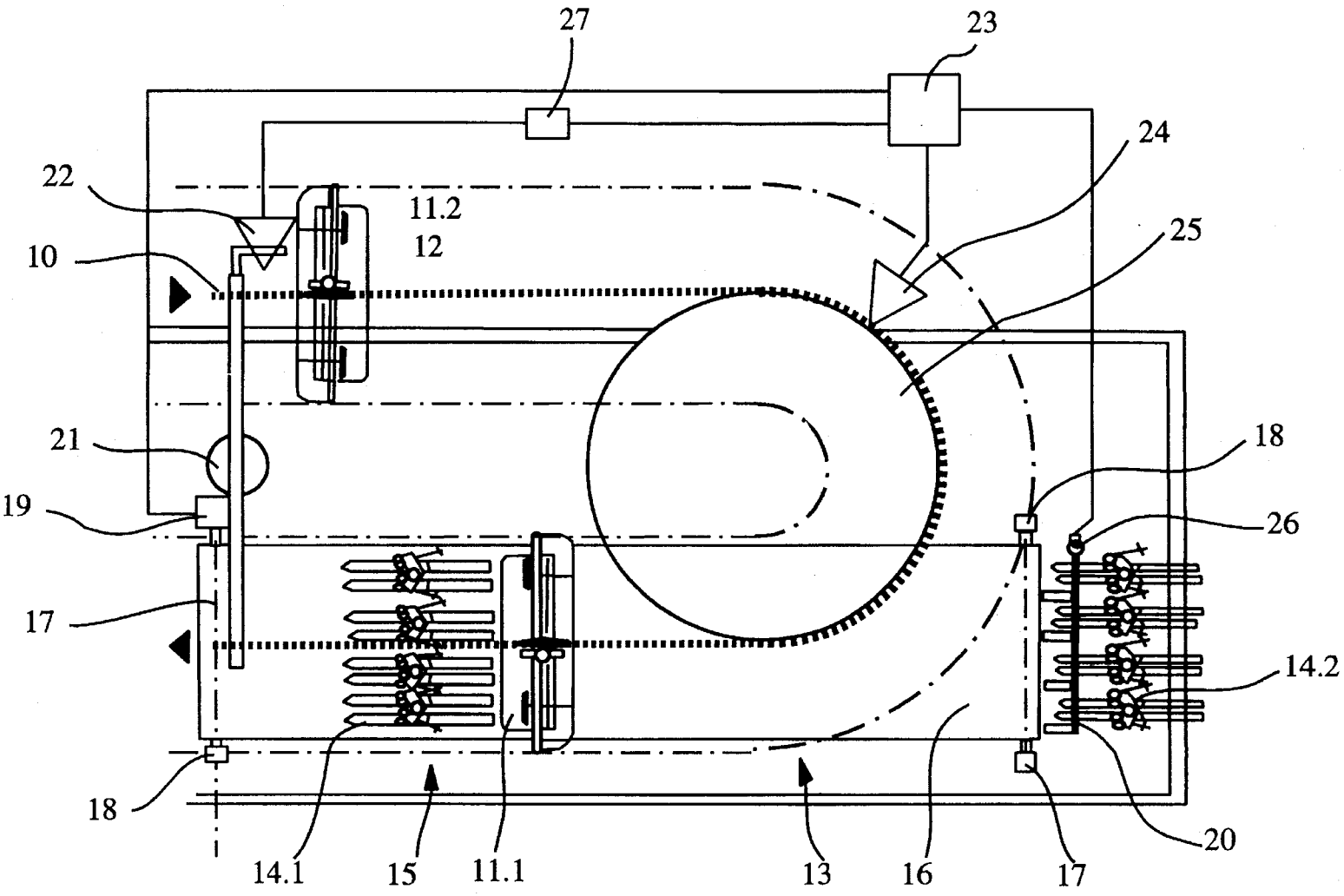
FIG. 1 corresponds to the figure of above mentioned co-pending application and is a schematic plan view of a loading system according to the invention.

In the figures, an overhead continuous moving cable 10 of a single cable chairlift extends between two terminals and runs in each terminal on a return pulley 25, one of which being driven in rotation by a motor. Chairs 11, each of which holds four passengers, for example, are coupled to the cable 10 by fixed grips 12 regularly spaced. At the exit of the pulley 25 the chairs 11 pass along a loading area 13 to catch up to the skiers 14 at a predetermined loading point 15. The skiers arrive from the rear of the terminal, in the centerline of the uphill cable path and move under the pulley 25 towards the loading point 15. Such chairlifts are well known.

The loading area 13 is equiped with a conveyor, constituted by an endless belt 16 extending between two end drums 17 each having an horizontal axis rotatably mounted in bearings 18. One of these drums 17 is driven in rotation by a motor 19 and the width of the conveyor belt 16 corresponds to the width of the chair 11. The conveyor belt 16 is colinear with the cable 10 in the loading area 13. At the entrance of the conveyor belt 16 and outside the travel path of the chairs, represented in dotted lines, is located a gate 20, for instance a signal light or a barrier extending across the entrance. The gate 20 is actuated by a motor 26 and the opening of the gate 20 allows the skiers to step onto the conveyor belt 16, which runs at a speed less than the speed of cable 10. The surface of the conveyor belt 16 has a high slipping coefficient relative to the sole of the ski to limit the shock at the instant of stepping on the belt 16.

A cable 10 support tower 21 is located at the entrance of the terminal and a chair passage detector 22 is rigidly secured to the tower 21, adjacent to the down hill path of the cable 10 so as to emit a signal at each passage of a chair 11. The detector 22 is connected by means of a time delay relay 27, to a central control unit 23 which controls the chairlift operation or at least the loading system with the conveyor belt 16. The chair passage detector 22 may be an electrical contact actuated by the chair passing along the detector. A cable speed detector 24 cooperates with the pulley 25 to emit a speed signal transmitted to the control unit 23. The control unit 23 controls the speed of the conveyor belt 16 and the opening of gate 20.

Figure 2:
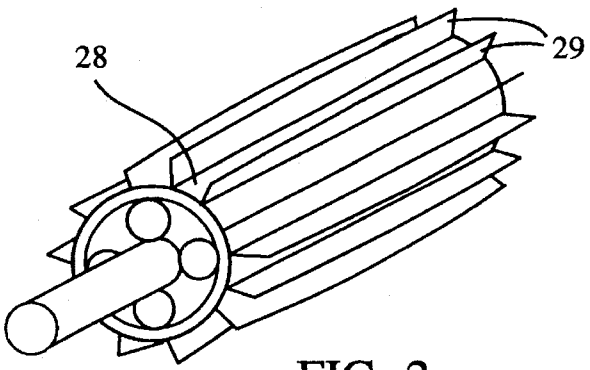
FIG. 2 is a view in perspective of a conveyor drum of FIG. 1.
Figure 3:
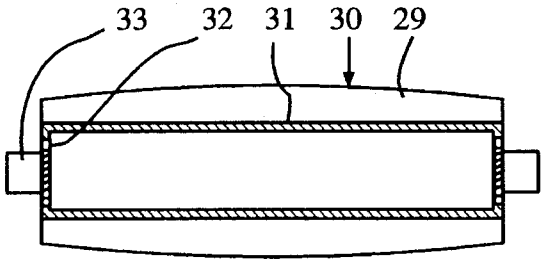
FIG. 3 is a sectional view of the drum of FIG. 2.

Referring to FIGS. 2 and 3, a hollow drum 17 is shown, having a barrel like outer shape slightly cambered or curved in the direction of its length, so that the belt 16 is automatically centralised onto the drum 17 during running. The outer drum surface presents grooves 28 extending parallel to the drum axis along the whole drum length. These grooves 28 are confined by fins 29 or ribs extending in radial plans of the drum and spaced around the circumference of the drum 17. The fins 29 have a curved front surface 30, whereto the belt 16 is applied, and an opposite surface welded to a cylindrical hollow core 31. The core 31 side walls 32 each supports a projecting pin 33 rotatably mounted in a bearing 18. The side walls 32 are provided with openings or holes (shown in FIG. 3), and the cylindrical surface of the core 31 is provided with openings or holes (not shown) so that the snow may escape into the hollow core central part and to the outside. It is clear that the snow is pushed into the grooves 28 by the belt 16 applied onto the drum 17 and is not allowed to pile up onto the outer drum surface.

Figure 4:
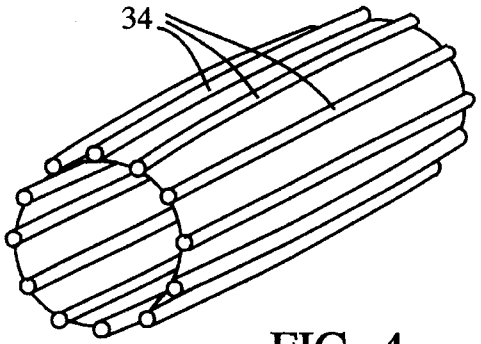
FIGS. 4, 5 and 6 are views in perspective of alternate embodiments of a drum.

In the form shown in FIG. 4 the drum 17 comprises longitudinal cylindrical rods 34 arranged as a squirrel cage having a curved barrel shape. The side walls (not shown) of this squirrel cage support the pins 33.

Figure 6:
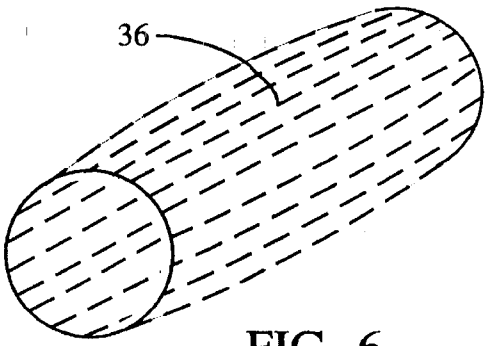
Figure 5:
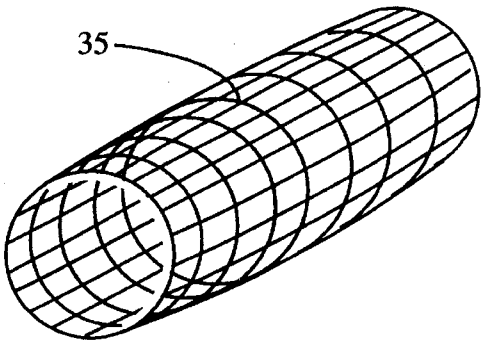

In the form shown in FIG. 5 the drum 17 is constituted by a lattice shaped net 35 and in FIG. 6 by a perforated cylindrical shaped metal sheet 36. It will be understood that the drum 17 may be realized in other ways, for instance in two parts, a cylindrical core and a barrel shaped sleeve secured onto the core.

What is claimed is:

1. A chairlift, comprising:

an endless overhead cable extending between two terminals, one of the two terminals having a skier loading area;

a plurality of chairs each coupled to the cable via a fixed grip; and a conveyor belt extending parallel to the cable along the skier loading area, for carrying skiers to a loading position, said conveyor belt comprising an endless belt passing around first and second spaced apart drums, said first drum having a barrel-shaped outer contour to centralize automatically the endless belt thereon, said first drum comprising (i) a hollow cylindrical body having two opposite open ends, (ii) a plurality of radial fins extending from said hollow cylindrical body, each of said radial fins extending along an axial direction of the hollow cylindrical body and having a curved outer edge, and (iii) two side walls respectively provided in the two opposite open ends of the hollow cylindrical body, said two side walls having a plurality of snow escaping holes therein.

* * * * *